US005269477A

United States Patent [19]

Buchholtz et al.

[11] Patent Number: 5,269,477

[45] Date of Patent: * Dec. 14, 1993

[54] WEAR-RESISTANT GRINDING DRUM FOR EMPLOYMENT IN ROLLER MACHINES, PARTICULARLY IN HIGH-PRESSURE ROLL PRESSES

[75] Inventors: Gustav Buchholtz, Kerpen; Guenter Keller, Bergisch Gladbach, both of Fed. Rep. of Germany

[73] Assignee: Kloeckner-Humboldt-Deutz AG, Fed. Rep. of Germany

[ * ] Notice: The portion of the term of this patent subsequent to Apr. 20, 2010 has been disclaimed.

[21] Appl. No.: 890,613

[22] Filed: May 28, 1992

[30] Foreign Application Priority Data

May 28, 1991 [DE] Fed. Rep. of Germany ..... 417435
Sep. 30, 1991 [DE] Fed. Rep. of Germany ..... 4132474

[51] Int. Cl.[5] ..... B02C 4/00; B02C 4/28

[52] U.S. Cl. ..... 241/293; 241/294

[58] Field of Search ..... 241/293, 229, 294, 300; 492/28, 30, 58

[56] References Cited

U.S. PATENT DOCUMENTS

| | | | |
|---|---|---|---|
| 412,558 | 10/1889 | Stephens | 241/300 X |
| 3,412,946 | 11/1968 | Gabler et al. | 241/293 |
| 4,848,683 | 7/1989 | Kawatsu | 241/294 |
| 5,203,513 | 4/1993 | Keller et al. | 241/293 |

*Primary Examiner*—Douglas D. Watts
*Attorney, Agent, or Firm*—Hill, Steadman & Simpson

[57] ABSTRACT

An improved roll for a roller press capable of withstanding very high nip forces in a press nip for interparticle crushing including embedding a plurality of spaced wear-resistant surface members in the pressing surface of the roll which are of a material harder than the material of the roll surface surrounding the inserts and by varying the size and number and material properties of the embedded pieces, the wear of the press roll is matched to the materials to be comminuted to minimize wear and to match the wear profile along the roll with extended pressing use.

20 Claims, 3 Drawing Sheets

WEAR-RESISTANT GRINDING DRUM FOR EMPLOYMENT IN ROLLER MACHINES, PARTICULARLY IN HIGH-PRESSURE ROLL PRESSES

BACKGROUND OF THE INVENTION

The invention relates to improvements in pressing rolls for withstanding the high nip forces in a high pressure roller press for interparticle crushing.

In particular, the present invention relates to an improved roll construction and the method of making the roll wherein unusually severe surface wear conditions exist in press nips having nip pressures which are capable of interparticle crushing. The new art of interparticle crushing has created new and unforeseen problems in generating surface wear of the rolls and in demanding improved nip draw-in capabilities. In interparticle crushing, two opposed rotatably seated rolls are separated from each other and form a draw-in nip therebetween wherein the pulverulent particles are drawn in and mutually crush each other.

What is referred to as interparticle crushing is a new art wherein individual particles of the grinding stock are drawn in and are mutually crushed in a product bed wherein the material fill is compressed between two roller surfaces with the application of an extremely high pressure as disclosed in such as patents as European Patent 0 084 383 and Schoenert U.S. Pat. No. 4,357,287. Other references and disclosures are found in the Beisner et al U.S. Pat. No. 4,703,897. In this art, the gap width and force applied between the rollers is such that a crushing fineness is attained by the particles entering the nip and mutually crushing one another and forming incipient cracks in the particle grains. This process and this equipment is a result of a new and unforeseen energy conservation with improved crushing.

The outer roll surfaces are subjected to extraordinarily high stressing from which among other things high wear results. It has been known to counter this wear on the basis of different shaping and coating of the drum surfaces exposed to wear. In European Published Application 0 361 172, various layers of different alloys are applied by welding to the base member of the roll for protection against wear. In U.S. application, Ser. No. 657,992, Filed Feb. 20, 1991, another approach has been proposed wherein with the employment of projections on the surface of the roll, the grinding material itself is retained on the roll surface to foster interparticle crushing, improve draw-in capabilities of the nip, and to improve the wear life.

An object of the invention is to provide an improved pressing roller which is capable of operating in an extremely high force nip environment with markedly reduced wear of the grinding surface as compared with rolls having constructions of the type heretofore known in the art.

A further object of the invention is to provide an improved interparticle crushing roll with a unique outer surface which provides for longer wear life and wherein the surface can be tailored to match the wear experience over the length of the roll with certain wear characteristics of a particular nip and a particular product being pressed.

A further object of the invention is to provide an improved press roll of the type for interparticle crushing wherein existing rolls can be modified or new rolls constructed to provide a roller wear surface of superior wear properties.

FEATURE OF THE INVENTION

The invention is based on the object of providing a grinding roll that has an extremely high resistance to wear. To minimize the wear of the surface regions of the roll which are exposed to wear, there is an embedding of a plurality of material over the surface of the roll but particularly in the region subjected to highest wear. These embedded members of material have a noticeably higher hardness than the material of the grinding drum that surrounds the pieces of material. What is unexpectedly achieved by embedding the larger pieces of material slight distances from each other is that the wear behavior of the grinding drum is defined almost exclusively by the embedded material.

By embedding the especially brittle but hard pieces of material into the material of the grinding roll, the high resistance of these brittle materials can be exploited while not detracting from the strength and other functional aspects of the roll. To attempt to manufacture a grinding roll made only of brittle materials, is not successful because of the involved manufacturing procedures, because of the difficulties in working, because of the other unsatisfactory aspects of a roll made all of brittle material, particularly when a grinding roll is used for interparticle crushing. The roll which may also be referred to as the grinding drum receives the embedded pieces of material by varying methods, such as by cementing the brittle inserts or pressing them into recesses formed in the surface of the drum member. In this way, a firm fit is produced between the brittle hard pieces of material and the drum surface. The joint between the inserts and the drum surface is retained and the functions of the drum are retained because of the elastic nature of the drum. It is also possible to produce a firm union between the inserts and the roll surface such as by shrinking, soldering, welding or by screwing in the inserts.

In another form of the invention, the region of the grinding drum which is exposed to wear is provided with a binding ring which is detachably connected to the outer surface of the roll by shrinking. With the coefficients of thermal expansion which are known of the binding material and the materials to be embedded therein, these can be matched so that a shrink elastic fit is achieved which will hold the embedded pieces firmly even when subjected to the high nip pressures that occur with interparticle crushing. In a form where the brittle inserts are held in place by a binding ring, a particularly strong support on the roll can be achieved by contraction of a binding ring which is shrunk fit onto the surface of the roll. In another form of the invention, the inserts are held on to the roll in the form of roller segments detachably joined to the surface of the roll. The pieces of material which are embedded can be embedded into the individual drum segments which is easier to implement in terms of production engineering than embedding the inserts directly into the drum member into binding rings.

It is also contemplated to co-cast the insert pieces in the surface when the roll or when the segments are cast. The inserts are provided in the mold from which the roll is cast or into the mold from which the segments are cast and this provides an interlocking connection between the support on the roll and the inserts.

In one form, the inserts are sleeve shaped or hollow and extend radially into the supporting roll. With this construction during operation of the rolls in a nip for interparticle crushing, the hollow insides of the inserts will fill with product material. This product material will be retained and automatic protection against wear is produced at these locations. The size of the sleeve is dimensioned such that the product material remains in the sleeves during the entire revolution of the rolls.

By a combination of the various embodiments, and by varying the size and numbers as well as the nature of the materials of the pieces of material to be embedded, it is possible to match the wear characteristic of the grinding drum to the different materials to be comminuted and thus to minimize the wear. It is possible on the basis of locally targeted embedding to insure that previously favored wear locations of the roll have priority protection against wear and the wear pattern of the grinding drum remains uniform over periods of use. This means that over the axial extent of the roll, uniform wear can be attained even though with roll constructions heretofore used, localized wear would occur.

The use of embedded brittle material of a hardness greater than the roll surface can be employed in various pressing apparatuses that must encounter particular surface pressure in rolling mills, chaser mills or drum and compacting presses.

Other objects, advantages and features will become more apparent with the teachings of the present invention in connection with the disclosure of the preferred embodiments thereof in the specification, claims and drawings in which:

DESCRIPTION OF THE PREFERRED EMBODIMENTS

Figure 1:
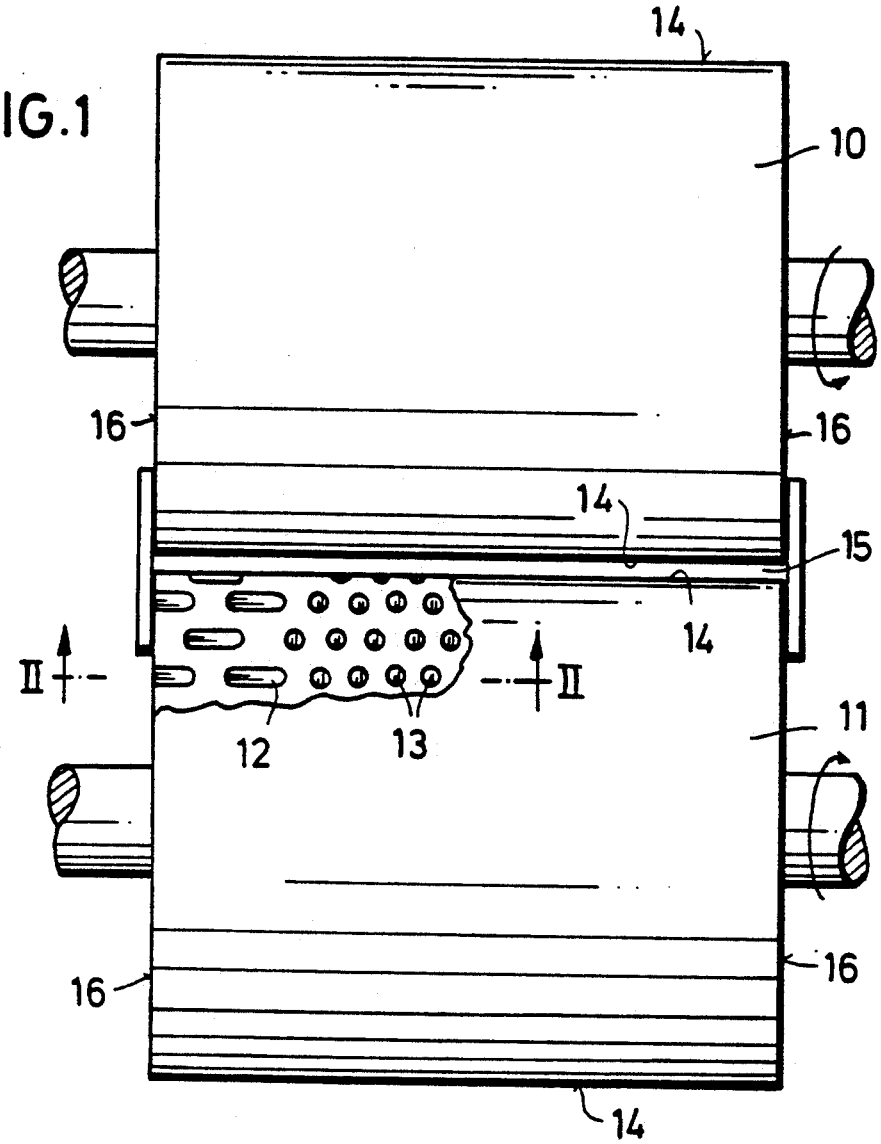
FIG. 1 is a plan view of opposed grinding rolls of a two roller machine with a spaced high pressure nip for interparticle crushing employing embedded wear-resistant inserts in accordance with the principles of the invention.

FIG. 1 illustrates a two roller press for comminution of granular material by interparticle crushing. The press is formed between cylindrical rolls 10 and 11 which form a press nip 15 therebetween. The rolls are suitably supported on high force bearings with means for adjusting the nip width and pressure to obtain the nip forces required for interparticle crushing as defined in the aforementioned Schoenert U.S. Pat. No. 4,357,287. Granular material is supplied from above the nip by a suitable product delivery shaft omitted for clarity from the drawing. End plates shown unnumbered are positioned at the end of the nip for aiding in retaining material and preventing it from exiting axially out the ends of the nip. A suitable receiving means is provided beneath the nip for receiving the comminuted material.

A plurality of wear-resistant brittle extremely hard pieces of material, which may be referred to as plate shaped or pin shaped, with the plate shaped or broader elongate inserts shown at 12 and circular pin shaped inserts at 13. Each of the inserts are seated in recesses extending radially into the roll and are held there securely so that the outer surface of the insert provides a brittle very hard surface between the intervening less hard drum surface shown at 14 in FIG. 2.

Figure 2:
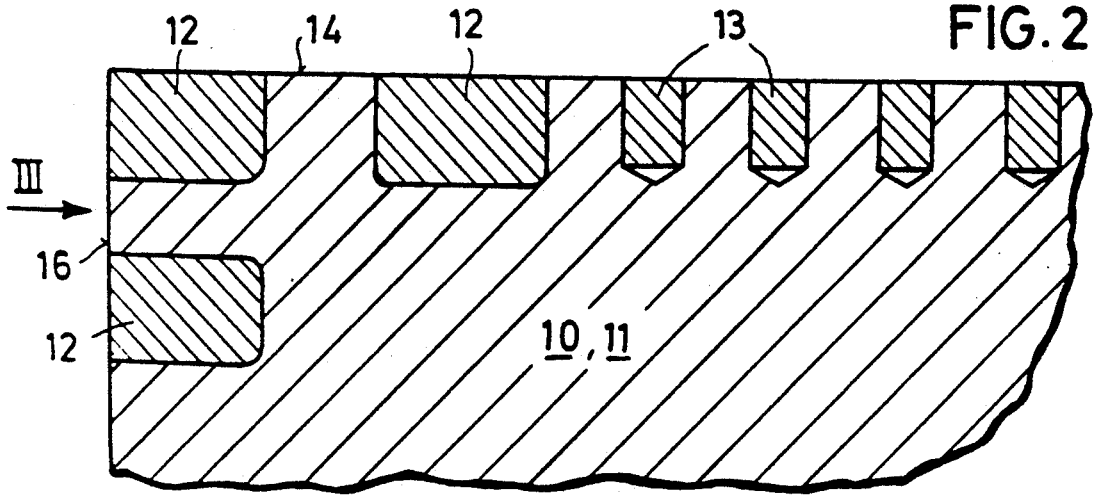
FIG. 2 is a fragmentary enlarged sectional view taken substantially along line II—II of FIG. 1.
Figure 3:
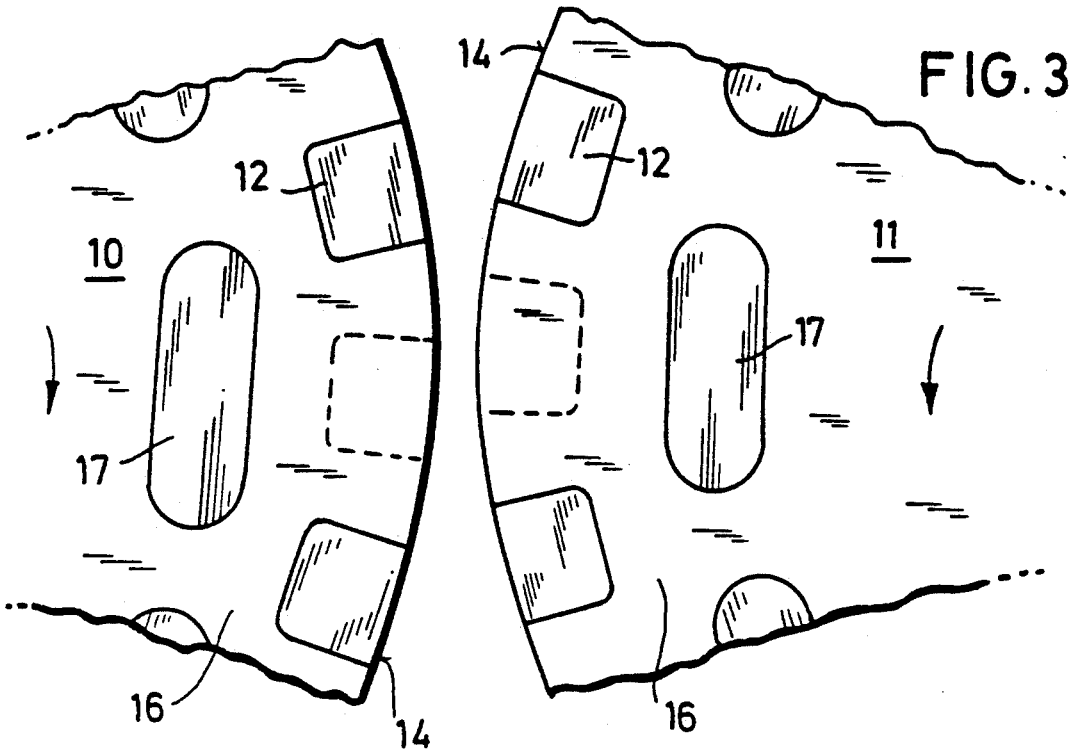
FIG. 3 is a fragmentary end elevational view of end faces of the grinding rolls of FIG. 1 with the view taken substantially as indicated by the arrowed line III of FIG. 2.

As shown in FIG. 3, the inserts have an outer surface which terminate flush in conformance with the surface 14 of the drum. In certain circumstances, the end faces 16, FIG. 1 of the drums, can be provided with inserts as shown at 12 in FIG. 2 and as shown at 17 in FIG. 3.

The arrangement or pattern of the inserts, which are illustrated in FIGS. 1 through 3, are shown as examples of the arrangement in which the inserts can advantageously be made. Also, the relative axial and circumferential spacing between the inserts is shown by way of example as well as the dimensions of the inserts. As illustrated in FIG. 1, in one form the exposed area of the inserts at the center of the roll are smaller than the area of the inserts at the edge with the center being circular shaped and the end inserts being plate shaped or oblong.

Figure 4:
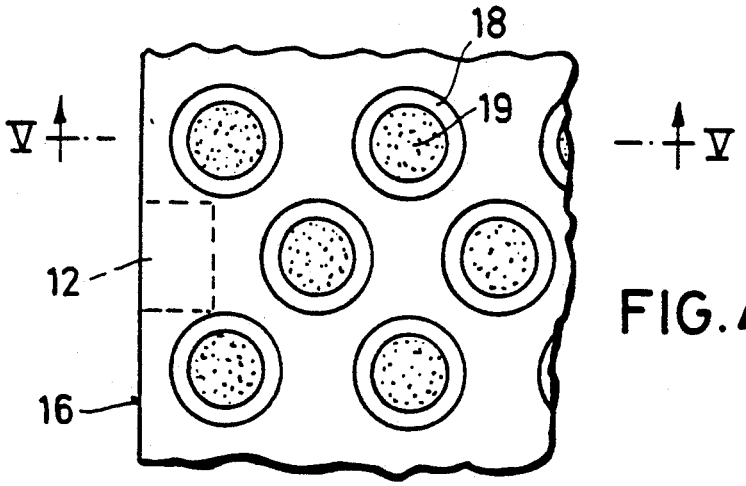
FIG. 4 is an enlarged fragmentary plan view of a grinding roll illustrating one form of embedded inserts in the roll surface.
Figure 5:
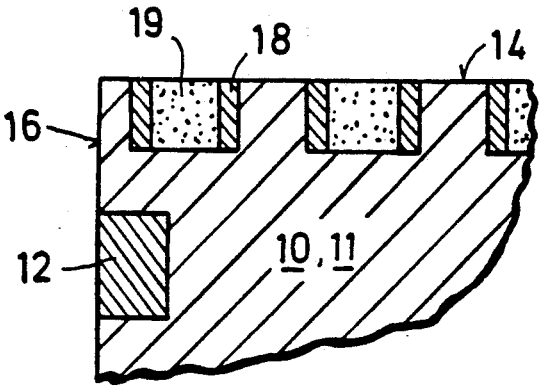
FIG. 5 is a fragmentary sectional view taken substantially along line V—V of FIG. 4.

As illustrated in FIGS. 4 and 5, the inserts are sleeve shaped or hollow cylindrical and are embedded into the surface of the drum member. The hollow inside of the sleeve shaped inserts are filled with material 19 during operation in interparticle crushing so that the material itself forms part of the crushing nip as the rolls operate. The size of the hollow interior of the sleeve shaped inserts 19 depends upon the type of material to be crushed, but the size is sufficient that the material is retained as the inserts leave the nip so that the material is carried around with the roll to again enter the nip.

In the arrangement illustrated in FIGS. 2, 3 and 4, pieces of material 12 are laminated into the end faces 16 of the drums. It is also possible to embed pin shaped or plate shaped pieces in the surface of the roll such as shown in FIGS. 4 and 5 in alternate locations between sleeve shaped inserts.

Figure 6:
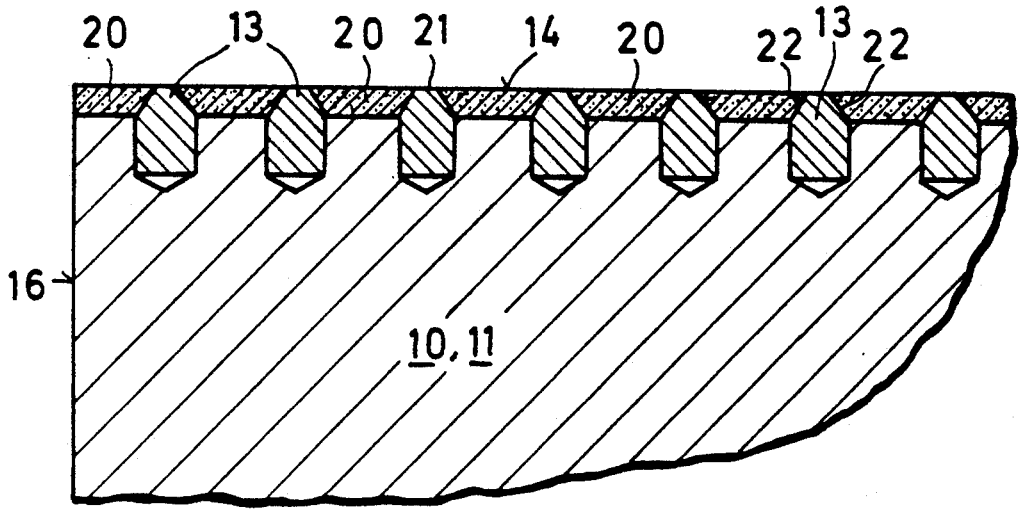
FIG. 6 is a fragmentary sectional view through a grinding roll with a section taken parallel to the drum axis illustrating another embodiment of the invention for holding the wear-resistant insert.

In the arrangement of FIG. 6, an arrangement is provided so that the inserts 13 have projecting outward a truncated cone shape. Thus only the tip of the cone shape insert is exposed to the crushing surface of the roll. The inserts 13 extend radially into the roll a sufficient distance to provide good retention and adequate lateral support. In operation, the shape of the truncated cone inserts counter lateral forces that attack projecting parts during operation of the rolls. These lateral forces can lead to undesirable torques and to projecting parts of the pin shaped pieces of inserts breaking off. It is also contemplated that the part which is shown truncated cone shaped can be hemispherically shaped.

In the interspaces between the projecting pin shaped inserts 13 of FIG. 6, this space can be filled up to the surface 21 with another material such as a ceramic compound or, for example, a plastic laced with ceramic materials. This presents a closed generated surface 14 of the drum. In one form, however, the interspaces between the projecting truncated cones can remain free so that they can fill with product material during operation of the rolls. Thus, during operation the material will provide a closed generated drum surface 14.

Thus, it will be seen that we have provided an improved roll structure which provides substantial advantages over devices heretofore available and which is particularly advantageous in interparticle crushing capable of withstanding the high nip pressures with continued reliable operation. Removal of the rolls from service and frequent repair becomes less necessary. Also, the arrangement provides for improved draw-in at the nip. By varying the pattern or hardness of the material of the inserts, a characteristic pattern of wear can be taken into consideration so that uniform nip operation and uniform wear are maintained during long periods of operation.

We claim as our invention:

1. A roll for a roller press capable of withstanding very high nip forces in a press nip for interparticle crushing, comprising in combination:
   a cylindrical press roll having an outer cylindrical pressing surface for use with an opposing roll in an interparticle crushing pressing nip;
   and a plurality of wear-resistant surface insert members embedded in the pressing surface of the roll being harder than the material of the roll surrounding said members;
   wherein the insert members project radially into the surface of the roll and the outer ends are truncated cone shaped for being firmly supported in the roll surface.

2. A roll for a roller press capable of withstanding very high nip forces in a press nip for interparticle crushing constructed in accordance with claim 1:
   wherein the embedded members are in the form of inserts extending radially into the shell having an external surface substantially conforming to the roll pressing surface.

3. A roll for a roller press capable of withstanding very high nip forces in a press nip for interparticle crushing constructed in accordance with claim 1:
   wherein the embedded members are supported extending radially into the roll and are sleeve shaped with hollow centers.

4. A roll for a roller press capable of withstanding very high nip forces in a press nip for interparticle crushing comprising in combination:
   a cylinder press roll having an outer cylindrical pressing surface for use with an opposing roll in an interparticle crushing pressing nip;
   and a plurality of wear-resistant surface insert members embedded in the pressing surface of the roll being harder than the material of the roll surrounding said members; and
   an annular binding ring surrounding the press roll and detachably secured to the outer surface thereof with said insert members supported in the binding ring.

5. A roll for a roller press capable of withstanding very high nip forces in a press nip for interparticle crushing constructed in accordance with claim 1:
   wherein said insert members are formed of a plurality of segments of identical size detachably secured to the roll.

6. A roll for a roller press capable of withstanding very high nip forces in a press nip for interparticle crushing constructed in accordance with claim 1:
   wherein said insert member is comprised of a hard metal material.

7. A roll for a roller press capable of withstanding very high nip forces in a press nip for interparticle crushing constructed in accordance with claim 1:
   wherein said inserted members are carried in recesses on the roll surface and are cemented into said recesses.

8. A roll for a roller press capable of withstanding very high nip forces in a press nip for interparticle crushing constructed in accordance with claim 1:
   including recesses in the roll surface with said insert members embedded in said recesses and having a larger lateral dimension than said recesses so that the inserts are held in the roll surface by pressure between the end sides of the recesses.

9. A roll for a roller press capable of withstanding very high nip forces in a press nip for interparticle crushing constructed in accordance with claim 1:
   wherein the insert members are partially embedded in the drum surface and spaces between the insert members are filled with another material.

10. A roll for a roller press capable of withstanding very high nip forces in a press nip for interparticle crushing constructed in accordance with claim 1:
   wherein said inserts are formed of a ceramic material.

11. A roll for a roller press capable of withstanding very high nip forces in a press nip for interparticle crushing constructed in accordance with claim 9:
   wherein said another material is ceramic.

12. A roll for a roller press capable of withstanding very high nip forces in a press nip for interparticle crushing comprising in combination:
   a cylinder press roll having an outer cylindrical pressing surface for use with an opposing roll in an interparticle crushing pressing nip;
   and a plurality of wear-resistant surface insert members embedded in the pressing surface of the roll being harder than the material of the roll surrounding said members;
   wherein inserts having a first surface area are provided intermediate the ends of the press roll;
   and inserts of a second exposed area are provided adjacent the ends of the roll.

13. A roll for a roller press capable of withstanding very high nip forces in a press nip for interparticle crushing constructed in accordance with claim 12:
   wherein the inserts at the ends are of a broader surface area than intermediate the ends.

14. A roll for a roller press capable of withstanding very high nip forces in a press nip for interparticle crushing constructed in accordance with claim 1:
   wherein inserts are provided on the circumferential surface of the roll and also at the radial ends of the roll.

15. A roll for a roller press capable of withstanding very high nip forces in a press nip for interparticle crushing constructed in accordance with claim 4:
   wherein said inserts are cylindrical in shape with a hollow center extending in a radial direction, said hollow center being of a dimension retained in the nip as the roll continues to rotate so that the grinding material presses other material in the nip for interparticle crushing.

16. The method of manufacturing a roll for a roller press capable of withstanding very high nip forces in a press nip for interparticle crushing comprising the steps:
   forming a cylindrical press roll having an outer cylindrical pressing surface for use with an opposing roll in an interparticle crushing press nip;

inserting a plurality of inserts into the roll surface at spaced intervals having a hardness greater than the roll surface; and including shrinking a binding ring onto the outer surface of the cylindrical press roll aiding in supporting the inserts in the roll surface.

17. The method of manufacturing a roll for a roller press capable of withstanding very high nip forces in a press nip for interparticle crushing comprising the steps:

forming a cylindrical press roll having an outer cylindrical pressing surface for use with an opposing roll in an interparticle crushing press nip;

inserting a plurality of inserts into the roll surface at spaced intervals having a hardness greater than the roll surface; and including casting said cylindrical press roll and positioning said plurality of inserts into the casting mold at spaced intervals to be held in the surface of the roll as the cast roll cools.

18. A roll for a roller press capable of withstanding very high nip forces in a press nip for interparticle crushing constructed in accordance with claim 4:

wherein the insert members are partially embedded in the drum surface and spaces between the insert members are filled with another material.

19. A roll for a roller press capable of withstanding very high nip forces in a press nip for interparticle crushing constructed in accordance with claim 18:

wherein said another material is ceramic.

20. A roll for a roller press capable of withstanding very high nip forces in a press nip for interparticle crushing constructed in accordance with claim 4:

wherein inserts are provided on the circumferential surface of the roll and also at the radial ends of the roll.

* * * * *